US005437377A

United States Patent [19]

Riemenschneider

[11] Patent Number: 5,437,377

[45] Date of Patent: Aug. 1, 1995

[54] TREE ATTACHABLE ARROW HOLDER

[76] Inventor: Alan F. Riemenschneider, 24369 178th St., Spirit Lake, Iowa 51360

[21] Appl. No.: 251,115

[22] Filed: May 31, 1994

[51] Int. Cl.[6] ..... A47F 5/00

[52] U.S. Cl. ..... 211/86; 211/60.1; 211/100; 211/104; 248/217.4; 248/316.8

[58] Field of Search ..... 248/217.4, 316.8, 291, 248/216.1; 211/59.1, 60.1, 106, 99, 100, 104, 86, 87

[56] References Cited

U.S. PATENT DOCUMENTS

| | | | |
|---|---|---|---|
| 1,580,796 | 4/1926 | Snyder | 211/104 |
| 3,233,745 | 2/1966 | Hershberger | 211/104 |
| 3,484,069 | 12/1969 | Larson | 211/100 X |
| 3,729,160 | 4/1973 | D'Imperio | 248/217.4 |
| 4,669,575 | 6/1987 | Skyba | 248/217.4 X |
| 4,697,669 | 10/1987 | Bergsten | 248/216.1 X |
| 5,054,628 | 10/1991 | Allen | 211/104 |
| 5,114,107 | 5/1992 | Mahn et al. | 248/217.4 |
| 5,310,150 | 5/1994 | Fecko | 248/217.4 X |
| 5,330,084 | 7/1994 | Peters | 248/291 X |

*Primary Examiner*—Robert W. Gibson, Jr.

[57] ABSTRACT

Disclosed is a tree attachable arrow holder for retaining a plurality of hunting arrows in a tree anchorable rack proximal a bow hunter atop a tree stand whereby the arrows are readily accessible to the hunter. The tree attachable arrow holder comprises a rack structure whereupon a plurality of arrows may be hung by the arrowhead. The rack structure comprises two parallel spaced apart support arms having upper and lower cross members fixedly transversely connected thereacross. A horizontal anchor screw is pivotally connected between the proximal ends of the spaced apart support arms to provide an installation position wherein the support arms extend generally normal the anchor screw forming a turning handle for driving the anchor screw into the tree and an operational position wherein the support arms extend generally parallel the anchor screw for holding arrows therebetween. The cross members contact the anchor screw shank whereby limiting pivotal travel of the rack structure to prevent the support arms from contacting the tree during installation and to prevent arrows from sliding off during operation.

8 Claims, 4 Drawing Sheets

TREE ATTACHABLE ARROW HOLDER

BACKGROUND OF THE INVENTION

1. Field of the Invention

The present invention relates to archery arrow racks and more particularly pertains to a tree attachable arrow holder which may be adapted for retaining a plurality of hunting arrows in a tree anchorable rack proximal a bow hunter atop a tree stand whereby the arrows are readily accessible to the hunter.

2. Description of the Prior Art

The use of archery arrow racks is known in the prior art. More specifically, archery arrow racks heretofore devised and utilized for the purpose of holding arrows are known to consist basically of familiar, expected and obvious structural configurations, notwithstanding the myriad of designs encompassed by the crowded prior art which have been developed for the fulfillment of countless objectives and requirements.

The present invention is directed to improving devices for holding arrows in a manner which is safe, secure, economical and aesthetically pleasing.

U.S. Pat. No. 4,621,606 to Toth describes an auxiliary arrow holder apparatus for holding a spare arrow on an archery bow, while U.S. Pat. No. 4,450,967 to Castro discloses an archery equipment storage rack.

The prior art also discloses a sportsman's gun rest and object holder as shown in U.S. Pat. No. 4,913,391 to Klipp, a tree step of U.S. Pat. No. 4,700,807 to Kubiak, and a portable tree stand or crows nest in U.S. Pat. No. 4,022,292 to Van Gompel.

While these devices fulfill their respective, particular objectives and requirements, the aforementioned patents do not disclose a tree attachable arrow holder for retaining a plurality of hunting arrows in a tree anchorable rack proximal a bow hunter atop a tree stand whereby the arrows are readily accessible to the hunter.

In this respect, the tree attachable arrow holder according to the present invention substantially departs from the conventional concepts and designs of the prior art, and in so doing provides an apparatus primarily developed for the purpose of retaining a plurality of hunting arrows in a tree anchorable rack proximal a bow hunter atop a tree stand whereby the arrows are readily accessible to the hunter.

Therefore, it can be appreciated that there exists a continuing need for a new tree attachable arrow holder which can be used for retaining a plurality of hunting arrows in a tree anchorable rack proximal a bow hunter atop a tree stand whereby the arrows are readily accessible to the hunter. In this regard, the present invention substantially fulfills this need.

As illustrated by the background art, efforts are continuously being made in an attempt to develop devices for holding arrows. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of archery arrow racks now present in the prior art, the present invention provides a new archery arrow rack construction wherein the same can be utilized for retaining a plurality of hunting arrows in a tree anchorable rack proximal a bow hunter atop a tree stand whereby the arrows are readily accessible to the hunter. As such, the general purpose of the present invention, which will be described subsequently in greater detail, is to provide a new tree attachable arrow holder apparatus and method which has all the advantages of the prior art archery arrow racks and none of the disadvantages.

The invention is defined by the appended claims with the specific embodiment shown in the attached drawings. For the purpose of summarizing the invention, the invention may be incorporated into a tree attachable arrow holder for retaining a plurality of hunting arrows in a tree anchorable rack proximal a bow hunter atop a tree stand whereby the arrows are readily accessible to the hunter. The tree attachable arrow holder comprises a rack structure whereupon a plurality of arrows may be hung by the arrowhead. The rack structure comprises first and second essentially identical parallel spaced apart elongated arrow support arms. Each support arm has a lateral through hole near a blunt proximal end thereof and a slightly upturned blunt distal end for preventing arrows from inadvertently sliding from the arms.

Upper and lower cross members are fixedly connected transverse the first and second support, arms. The upper cross member is positioned, intermediate the lateral through holes and the distal ends of the support arms near the lateral holes. The lower cross member is positioned intermediate the proximal ends and the lateral through holes of the support arms near the proximal ends thereof.

A horizontal anchor screw is included for driving into a tree. The anchor screw has an elongated shank with a lateral through hole near a blunt distal end thereof. The anchor screw shank is disposed between the proximal ends of the spaced apart support arms such that the lateral through holes of the anchor screw and the first and second support arms align with each other.

A hinge pin extends through the lateral through holes of the anchor screw and the first and second support arms such that the rack structure is pivotable to an installation position wherein the support arms extend generally normal the anchor screw forming a turning handle for driving the anchor screw into the tree. The cross members contact the anchor screw shank whereby limiting pivotal travel of the rack structure to prevent the support arms from contacting the tree. The rack structure is also pivotable to an operational position wherein the support arms extend generally horizontally parallel the anchor screw for holding arrows therebetween. The cross members contact the anchor screw shank whereby limiting pivotal travel of the rack structure to prevent arrows from sliding from the support arms.

There has thus been outlined, rather broadly, the more important features of the invention in order that the detailed description thereof that follows may be better understood, and in order that the present contribution to the art may be better appreciated. There, are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a tree attachable arrow holder for retaining a plurality of hunting arrows in a tree anchorable rack proximal a bow hunter atop a tree stand whereby the arrows are readily accessible to the hunter.

It is another object of the present invention to provide a new tree attachable arrow holder which may be easily and efficiently manufactured and marketed.

It is a further object of the present invention to provide a new tree attachable arrow holder which is of a durable and reliable construction.

An even further object of the present invention is to provide a new tree attachable arrow holder which is susceptible of a low cost of manufacture with regard to both materials and labor, and which accordingly is then susceptible of low prices of sale to the consuming public, thereby making such tree attachable arrow holders economically available to the buying public.

Still yet another object of the present invention is to provide a new tree attachable arrow holder which provides in the apparatuses and methods of the prior art some of the advantages thereof, while simultaneously overcoming some of the disadvantages normally associated therewith.

Still yet another object of the present invention is to provide a tree attachable arrow holder that is light weight and compact making it easy to be carried for extended periods over long distances.

Yet another object of the present invention is to provide a tree attachable arrow holder that will accommodate all types of conventional hunting arrows with broadheads.

Even still another object of the present invention is to provide a tree attachable arrow holder that may be quickly and easily attached to and removed from a supporting tree.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and description matter in which there is illustrated preferred embodiments of the invention. The foregoing has outlined some of the more pertinent objects of this invention. These objects should be construed to be merely illustrative of some of the more prominent features and applications of the present invention. Many ether beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
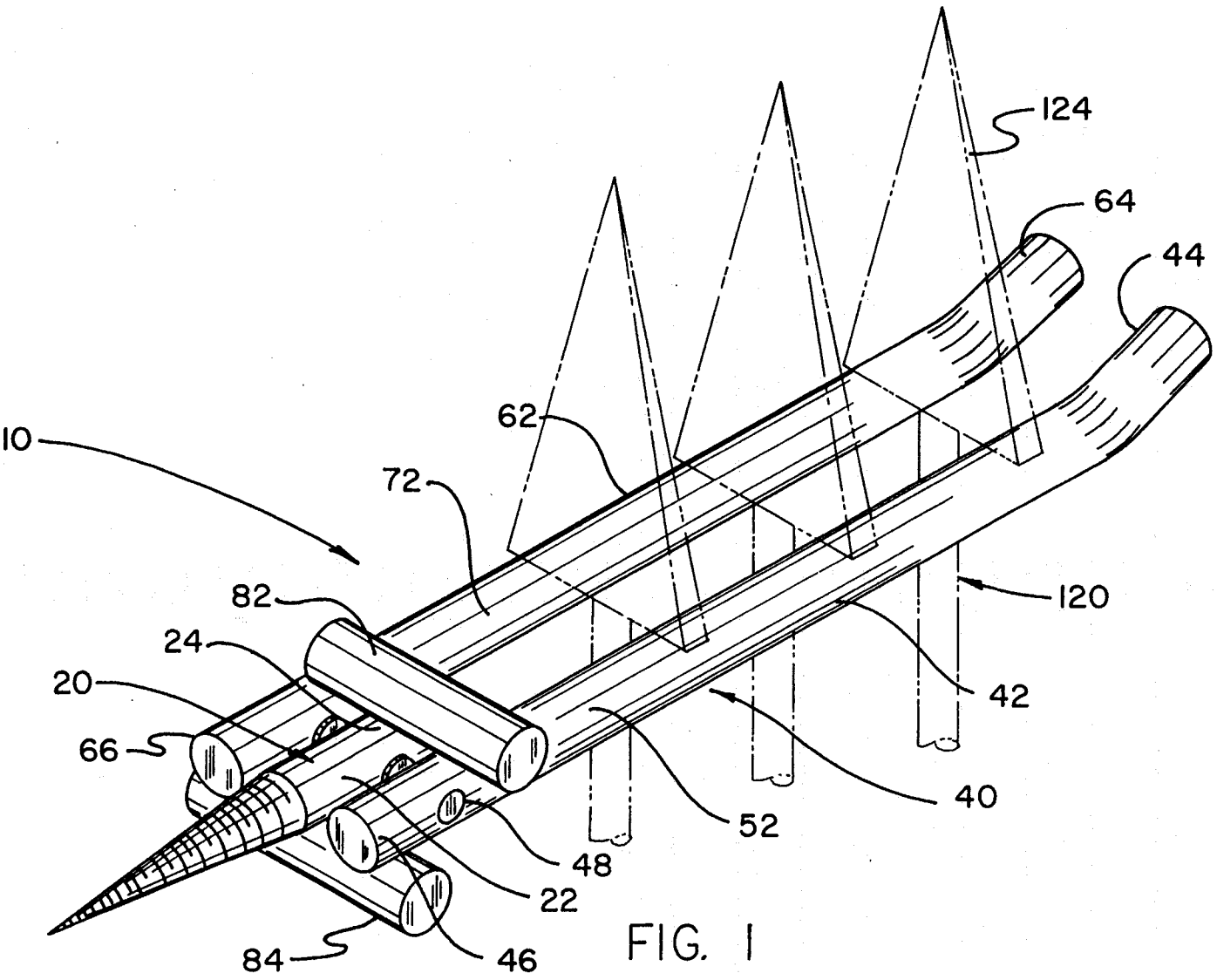
FIG. 1 is a top perspective view of the preferred embodiment of the attachable arrow holder showing the manner in which arrows are held.
Figure 2:
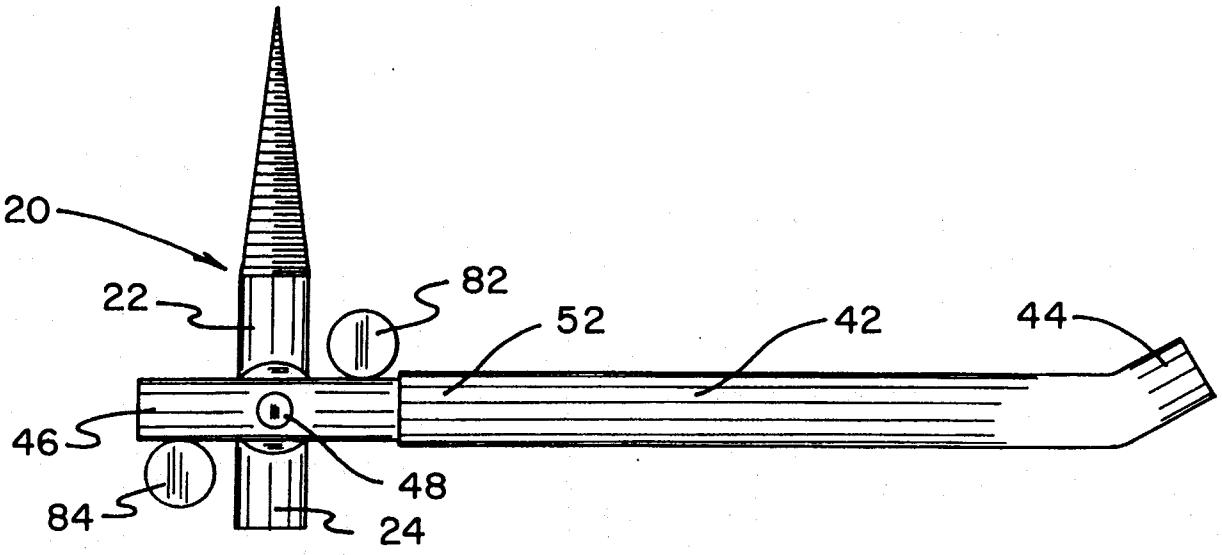
FIG. 2 is a side elevational view of the invention of FIG. 1 in the installation position.
Figure 3:
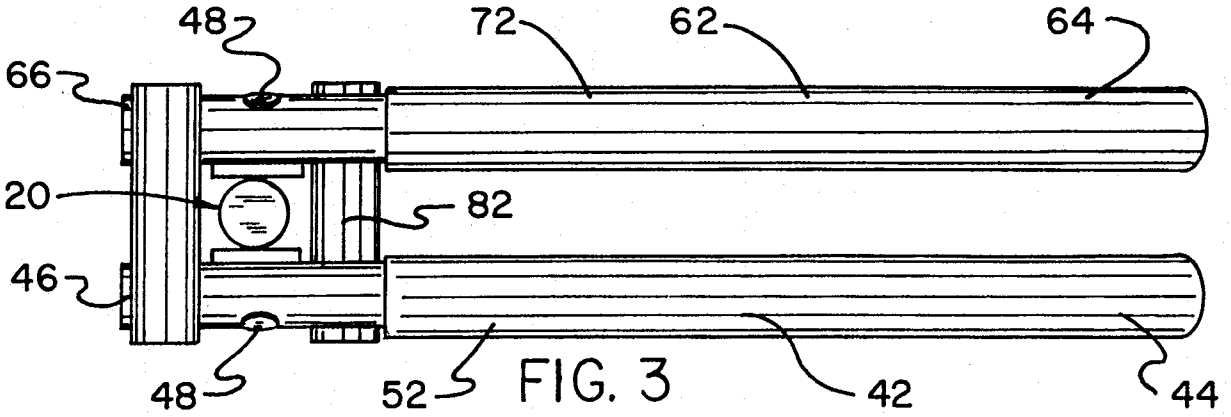
FIG. 3 is a rear elevational view of the invention of FIG. 2.
Figure 4:
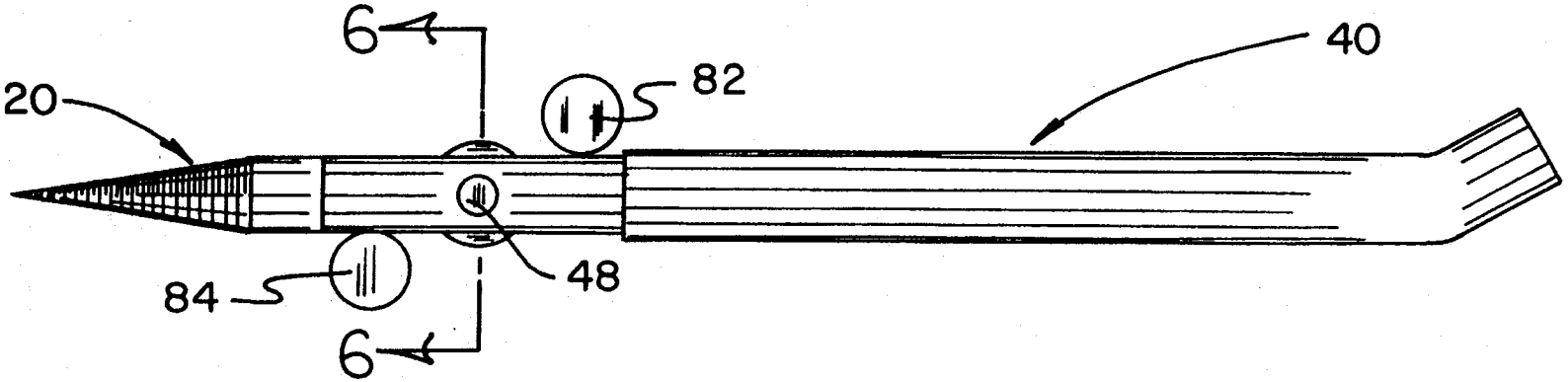
FIG. 4 is a side elevational view of the invention of FIG. 1 in the operational position.
Figure 5:
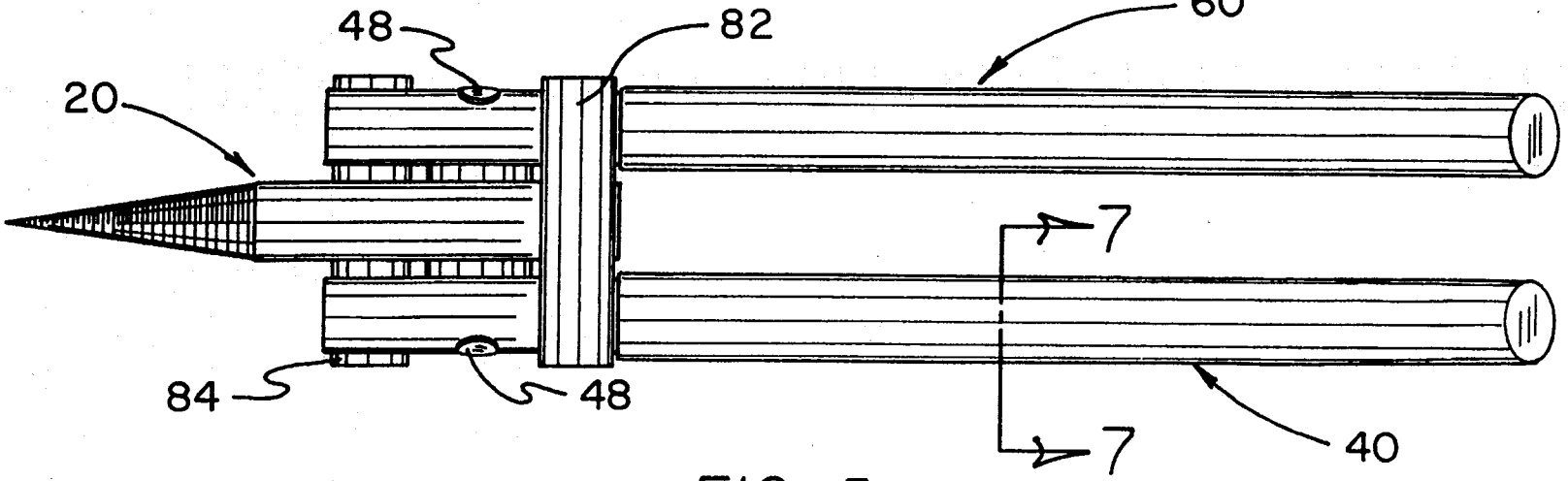
FIG. 5 is a top plan view of the invention of FIG. 4.
Figure 6:
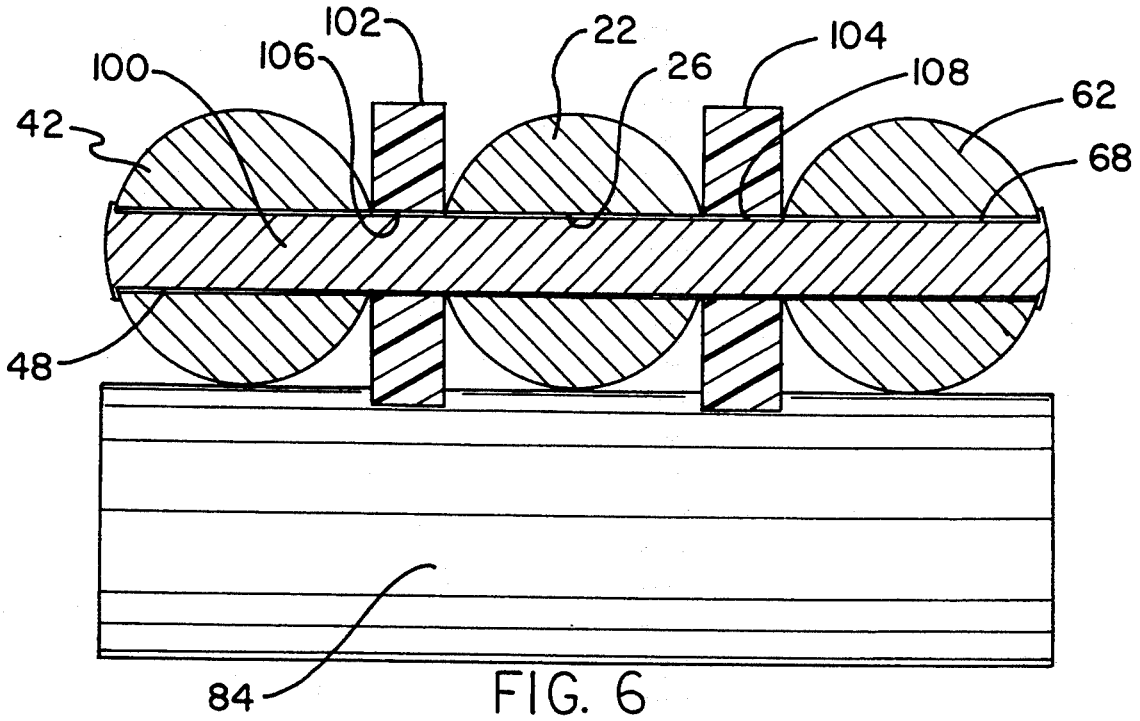
FIG. 6 is a sectional view of the invention of FIG. 4 taken along the line 6—6.
Figure 7:
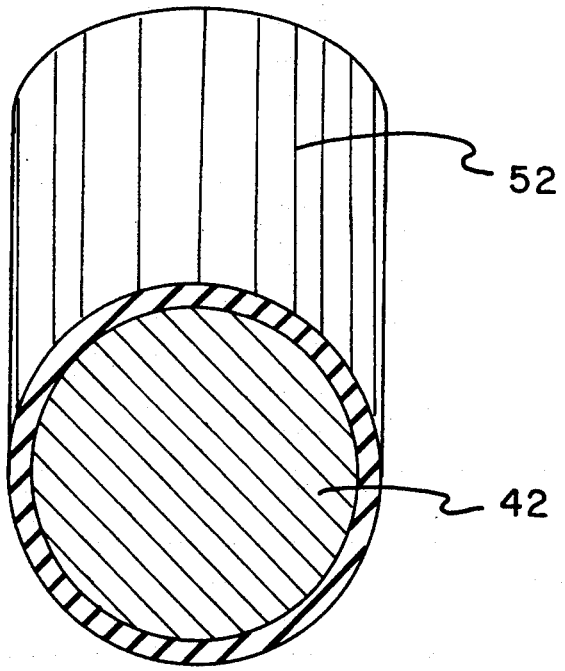
FIG. 7 is a sectional view of the invention of FIG. 5 taken along the line 7—7.

With reference now to the drawings, and in particular to FIG. 1 thereof, a tree attachable arrow holder embodying the principles and concepts of the present invention and generally designated by the reference numeral 10 will be described.

From an overview standpoint, the tree attachable arrow holder is adapted for use for retaining a plurality of hunting arrows in a tree anchorable rack proximal a bow hunter atop a tree stand whereby the arrows are readily accessible to the hunter. See FIG. 1.

With reference now to FIGS. 1–7 and more specifically, it will be noted that a tree attachable arrow holder 10 is shown. The tree attachable arrow holder 10 comprises a rack structure 40 whereupon a plurality of arrows 120 may be hung by the arrowhead 124. The rack structure 40 comprises first and second essentially identical parallel elongated arrow support arms 42 and 62 formed of ¼-inch diameter rod. The support arms 42 and 62 are spaced apart 7/16-inch to accommodate most hunting arrows having broadheads. Each support arm 42 (or 62) has a lateral through hole 48 (or 68) near a blunt proximal end 46 (or 66) thereof and a slightly upturned blunt distal end 44 (or 64) for preventing arrows 120 from inadvertently sliding from the arms 42 and 62. The support arms further include a resilient coating 52 and 72 for reducing arrow slippage on the arms 42 and 62.

Upper and lower cross members 82 and 84, also formed of ¼-inch diameter rod, are fixedly connected transverse the first and second support arms 42 and 62. The upper cross member 82 is positioned intermediate the lateral through holes 48 and 68 and the distal ends 44 and 64 of the support arms near the lateral holes 48 and 68. The lower cross member 84 is positioned intermediate the proximal ends 46 and 66 and the lateral through holes 48 and 68 of the support arms near the proximal ends 46 and 66 thereof.

A horizontal anchor screw 20 is included for driving into a tree. The anchor screw 20 has an elongated ¼-inch diameter shank 22 with a lateral through hole 26 near a blunt distal end 24 thereof. The anchor screw shank 22 is disposed between the proximal ends 46 and 66 of the spaced apart support arms 42 and 62 such that the lateral through holes 26, 48, and 68 of the anchor screw 20 and the first and second support arms 42 and 62 align with each other.

A ⅛-inch diameter roll pin hinge pin 100 extends through the lateral through holes 26, 48, and 68 of the anchor screw 20 and the first and second support arms 42 and 62 such that the rack structure 40 is pivotable to an installation position wherein the support arms 42 and 62 extend generally normal the anchor screw 20 forming a turning handle for driving the anchor screw 20 into the tree. The cross members 82 and 84 contact the anchor screw shank 22 whereby limiting pivotal travel of the rack structure 40 to prevent the support arms 42 and 62 from contacting the tree. The rack structure 40 is also pivotable to an operational position wherein the support arms 42 and 62 extend generally horizontally parallel the anchor screw 20 for holding arrows 120 therebetween. The cross members 82 and 84 contact the anchor screw shank 22 whereby limiting pivotal travel of the rack structure 40 to prevent arrows 120 from sliding from the support arms 42 and 62.

Bushing means is also included for improving pivotal movement of the rack structure 40 relative the anchor screw 20. The bushing means comprises first and second discoid nylon bushings 102 and 104, each having a central through hole 106 and 108 therethrough. The first bushing 102 is disposed on the hinge pin 100 between the anchor screw shank 22 and the first support arm 42. The second bushing 104 is disposed on the hinge pin 100 between the anchor screw shank 22 and the second support arm 62.

In use, the anchor screw 20 is positioned against the tree and the rack structure 40 is pivoted perpendicularly thereto. Longitudinal pressure is applied to the anchor screw 20 by bearing against the blunt end 24 thereof. Using the rack structure 40 as a lever, the anchor screw 20 is rotated until it is embedded into the tree. The rack structure 40 is then pivoted to a horizontal position parallel the anchor screw 20 and arrows 120 are hung on the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described.

What is claimed is:

1. A tree attachable arrow holder for retaining a plurality of hunting arrows in a tree anchorable rack proximal a bow hunter atop a tree stand whereby the arrows are readily accessible to the hunter, the tree attachable arrow holder comprising:

a rack structure whereupon a plurality of arrows may be hung by the arrowhead, the rack structure comprising: first and second essentially identical parallel spaced apart elongated arrow support arms, each support arm having a lateral through hole near a blunt proximal end thereof and a slightly upturned blunt distal end for preventing arrows from inadvertently sliding from the arms; upper and lower cross members fixedly connected transverse the first and second support arms, the upper cross member being positioned intermediate the lateral through holes and the distal ends of the support arms near the lateral holes thereof, the lower cross member being positioned intermediate the proximal ends and the lateral through holes of the support arms near the proximal ends thereof;

a horizontal anchor screw for driving into a tree, the anchor screw having an elongated shank with a lateral through hole near a blunt distal end thereof, the anchor screw shank being disposed between the proximal ends of the spaced apart support arms such that the lateral through holes of the anchor screw and the first and second support arms align with each other; and a hinge pin extending through the lateral through holes of the anchor screw and the first and second support arms such that the rack structure is pivotable to an installation position wherein the support arms extend generally normal the anchor screw forming a turning handle for driving the anchor screw into the tree, the cross members contacting the anchor screw shank whereby limiting pivotal travel of the rack structure to prevent the support arms from contacting the tree, the rack structure being pivotable to an operational position wherein the support arms extend generally horizontally parallel the anchor screw for holding arrows therebetween, the cross members contacting the anchor screw shank whereby limiting pivotal travel of the rack structure to prevent arrows from sliding from the support arms.

2. The tree attachable arrow holder of claim 1 wherein the support arms further include a resilient coating for reducing arrow slippage on the arm.

3. The tree attachable arrow holder of claim 2 and further including bushing means for improving pivotal movement of the rack structure relative the anchor screw, the bushing means comprising first and second discoid bushings each having a central through hole therethrough, the first bushing being disposed on the hinge pin between the anchor screw shank and the first support arm, the second bushing being disposed on the hinge pin between the anchor screw shank and the second support arm.

4. The tree attachable arrow holder of claim 3 wherein the discoid bushings are formed of nylon.

5. The tree attachable arrow holder of claim 4 wherein the support arms, the anchor screw, and the cross members are formed of round metal rod.

6. The tree attachable arrow holder of claim 5 wherein the rod has a $\frac{1}{4}$-inch diameter.

7. The tree attachable arrow holder of claim 6 wherein the hinge pin comprises a roll pin having a $\frac{1}{8}$-inch diameter.

8. The tree attachable arrow holder of claim 7 wherein the spacing between the first and second support arms is 7/16-inches.

* * * * *